US009284955B2

(12) United States Patent
Hiratsuka et al.

(10) Patent No.: US 9,284,955 B2
(45) Date of Patent: Mar. 15, 2016

(54) COMPRESSOR

(75) Inventors: Takeshi Hiratsuka, Shiga (JP); Osamu Aiba, Shiga (JP); Takeshi Hashimoto, Shiga (JP); Akinori Fukuda, Shiga (JP); Shiho Furuya, Kyoto (JP); Atsushi Sakuda, Shiga (JP); Yoshiyuki Futagami, Shiga (JP); Hiroyuki Kawano, Shiga (JP); Yusuke Imai, Shiga (JP); Takashi Morimoto, Kyoto (JP); Tatsuya Nakamoto, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 147 days.

(21) Appl. No.: 13/522,182

(22) PCT Filed: Dec. 22, 2011

(86) PCT No.: PCT/JP2011/007214

§ 371 (c)(1),
(2), (4) Date: Oct. 23, 2012

(87) PCT Pub. No.: WO2012/127553

PCT Pub. Date: Sep. 27, 2012

(65) Prior Publication Data

US 2013/0039792 A1 Feb. 14, 2013

(30) Foreign Application Priority Data

Mar. 18, 2011 (JP) ..... 2011-059986
Jul. 15, 2011 (JP) ..... 2011-156413
Oct. 13, 2011 (JP) ..... 2011-225589

(51) Int. Cl.
*F01C 1/063* (2006.01)
*F04B 39/04* (2006.01)

(Continued)

(52) U.S. Cl.
CPC ..... *F04B 39/04* (2013.01); *F04B 39/0246* (2013.01); *F04C 18/0215* (2013.01);

(Continued)

(58) Field of Classification Search
CPC ..... F04C 18/0215; F04C 29/026; F04C 2210/14; F04C 29/02; F01C 21/04; F04B 39/0055; F25B 2400/02; F25B 43/02
USPC ..... 418/55.1, 55.5, 55.6
See application file for complete search history.

(56) References Cited

U.S. PATENT DOCUMENTS 6,227,831 B1 5/2001 Osima et al.
7,537,436 B2 5/2009 Kitamura et al.

(Continued)

FOREIGN PATENT DOCUMENTS

CN 1643255 7/2005
CN 1837618 9/2006

(Continued)

*Primary Examiner* — Jesse Bogue
*Assistant Examiner* — Thomas Olszewski
(74) *Attorney, Agent, or Firm* — Hamre, Schumann, Mueller & Larson, P.C.

(57) ABSTRACT

According to a compressor of the present invention, the compressor further comprises an oil separating mechanism 40 which separates oil from the refrigerant gas discharged from the compressing mechanism 10, the oil separating mechanism 40 includes a cylindrical space 41 in which the refrigerant gas orbits, an inflow portion 42 for flowing the refrigerant gas discharged from the compressing mechanism 10 into the cylindrical space 41, a sending-out port 43 for sending out, from the cylindrical space 41 to the one container space 32, the refrigerant gas from which the oil is separated, and an exhaust port 44 for discharging the separated oil and a portion of the refrigerant gas from the cylindrical space 41, and a center of the sending-out port 43 is deviated in a direction opposite from the inflow portion 42 from a center axis of the cylindrical space 41.

10 Claims, 9 Drawing Sheets

(51) Int. Cl.

| | |
|---|---|
| ***F04C 23/00*** | (2006.01) |
| ***F04B 39/02*** | (2006.01) |
| ***F04C 29/02*** | (2006.01) |
| ***F04C 18/02*** | (2006.01) |
| ***F04C 29/12*** | (2006.01) |
| *F04C 29/06* | (2006.01) |

(52) U.S. Cl.

CPC ..... *F04C18/0261* (2013.01); *F04C 23/008* (2013.01); *F04C 29/026* (2013.01); *F04C 29/12* (2013.01); *F04C 29/065* (2013.01)

(56) References Cited

U.S. PATENT DOCUMENTS

| | | | | |
|---|---|---|---|---|
| 7,862,313 | B2 * | 1/2011 | Hwang et al. | 418/55.6 |
| 8,202,071 | B2 * | 6/2012 | Kii et al. | 418/55.6 |
| 2003/0219351 | A1 | 11/2003 | Hiwata et al. | |
| 2005/0069423 | A1 | 3/2005 | Ebara et al. | |
| 2005/0106041 | A1 | 5/2005 | Kitamura et al. | |
| 2008/0038133 | A1 * | 2/2008 | Sawai et al. | 418/55.6 |

FOREIGN PATENT DOCUMENTS

| | | | |
|---|---|---|---|
| CN | 101725528 | 6/2010 | |
| DE | 102007024897 | 1/2008 | |
| EP | 2131040 | 12/2009 | |
| EP | 2182307 | 5/2010 | |
| JP | 60-75797 | 4/1985 | |
| JP | 5-044667 | 2/1993 | |
| JP | 6-10852 | 1/1994 | |
| JP | 11-093880 | 4/1999 | |
| JP | 2001-280252 | * 10/2001 | F04B 39/04 |
| JP | 2003-269336 | 9/2003 | |
| JP | 2004-60605 | 2/2004 | |
| JP | 2004-084662 | 3/2004 | |
| JP | 2005-105986 | 4/2005 | |
| JP | 2005-180295 | 7/2005 | |
| JP | 2006-90180 | 4/2006 | |
| JP | 2006-342722 | 12/2006 | |
| JP | 2008-8285 | 1/2008 | |
| JP | 2008-088929 | 4/2008 | |
| JP | 2008-175066 | 7/2008 | |
| JP | 2010-174902 | 8/2010 | |

* cited by examiner

COMPRESSOR

TECHNICAL FIELD

The present invention relates to a compressor which includes anon separating mechanism which separates oil from refrigerant gas which is discharged from a compressing mechanism.

BACKGROUND TECHNIQUE

A conventional compressor used for an air conditioning system and a cooling system includes a compressing mechanism and an electric motor which drives the compressing mechanism, and both the compressing mechanism and electric motor are provided in a casing. The compressing mechanism compresses refrigerant gas which returned from a refrigeration cycle, and sends the refrigerant gas to the refrigeration cycle. Generally, refrigerant gas compressed by the compressing mechanism once flows around the electric motor, thereby cooling the electric motor and then, the refrigerant gas is sent to the refrigeration cycle from a discharge pipe provided in the casing (see patent document 1 for example). That is, refrigerant gas compressed by the compressing mechanism is discharged from a discharge port to a discharge space. Thereafter, the refrigerant gas passes through a passage provided in an outer periphery of a frame, and is discharged into an upper portion of an electric motor space between the compressing mechanism and the electric motor. A portion of the refrigerant gas cools the electric motor and then is discharged from the discharge pipe. Other refrigerant gas brings upper and lower electric motor spaces of the electric motor into communication with each other through a passage formed between the electric motor and an inner wall of the casing, cools the electric motor, passes through a gap between a rotor and a stator of the electric motor, enters the electric motor space in the upper portion of the electric motor and is discharged out from the discharge pipe.

PRIOR ART DOCUMENT

Patent Document

[Patent Document 1] Japanese Patent Application Laid-open No. H5-44667

SUMMARY OF THE INVENTION

Problem to be Solved by the Invention

According to the conventional configuration, however, there is a problem that since high temperature and high pressure refrigerant gas compressed by the compressing mechanism flows through the electric motor, the electric motor is heated by the refrigerant gas, and efficiency of the electric motor is deteriorated.

Further, since high temperature discharge gas flows through a lower portion of the compressing mechanism via the passage provided in the outer periphery of the frame, the compressing mechanism is heated, and especially low temperature refrigerant gas which returned from the refrigeration cycle receives heat when the refrigerant gas is sent to a compression chamber through a suction path. Hence, there is a problem that the refrigerant gas is already expanded when the refrigerant gas is enclosed in the compression chamber, and a circulation amount is reduced by the expansion of the refrigerant gas.

Further, if a large amount of oil is included in refrigerant which is discharged from a discharge pipe, there is a problem that cycle performance is deteriorated.

The present invention is accomplished to solve the conventional problems, and it is an object of the invention to provide a compressor which enhances efficiency of the electric motor and volumetric efficiency in the compression chamber and realized low oil circulation.

Means for Solving the Problems

The present invention provides a compressor in which the compressor further comprises an oil separating mechanism which separates oil from the refrigerant gas discharged from the compressing mechanism, the oil separating mechanism includes a cylindrical space in which the refrigerant gas orbits, an inflow portion for flowing the refrigerant gas discharged from the compressing mechanism into the cylindrical space, a sending-out port for sending out, from the cylindrical space to the one container space, the refrigerant gas from which the oil is separated, and an exhaust port for discharging the separated oil and a portion of the refrigerant gas from the cylindrical space, and a center of the sending-out port is deviated in a direction opposite from the inflow portion from a center axis of the cylindrical space.

Effect of the Invention

According to the invention, most of high temperature and high pressure refrigerant gas which is compressed by the compressing mechanism and sent out from the oil separating mechanism is guided into one of the container spaces and discharged from the discharge pipe. Therefore, since the most of high temperature and high pressure refrigerant gas does not pass through the electric motor, the electric motor is not heated by the refrigerant gas, and efficiency of the electric motor is enhanced.

According to the invention, most of the high temperature and high pressure refrigerant gas is guided into the one container space, and it is possible to restrain the compressing mechanism which is in contact with the other container space from being heated. Therefore, it is possible to restrain the sucked refrigerant gas from being heated, and high volumetric efficiency in the compression chamber can be obtained.

According to the invention, oil which is separated by the oil separating mechanism is discharged out together with refrigerant gas from the discharge port located at a position opposed to the sending-out port. Hence, oil does not build up in the cylindrical space almost at all. Therefore, a case where the separated oil is blown up in the cylindrical space by the orbiting refrigerant gas and is sent out from the sending-out port together to refrigerant gas does not occur, and the oil can be separated stably. Further, since oil does not build up in the cylindrical space, the cylindrical space can be made small.

According to the invention, it is possible to restrain refrigerant gas which flowed into the cylindrical space from being directly sent out from the inflow portion to the sending-out port before oil is separated from the refrigerant gas by the oil separating mechanism, and the ability of the oil separating mechanism can sufficiently be exerted.

EXPLANATION OF SYMBOLS

Figure 1:
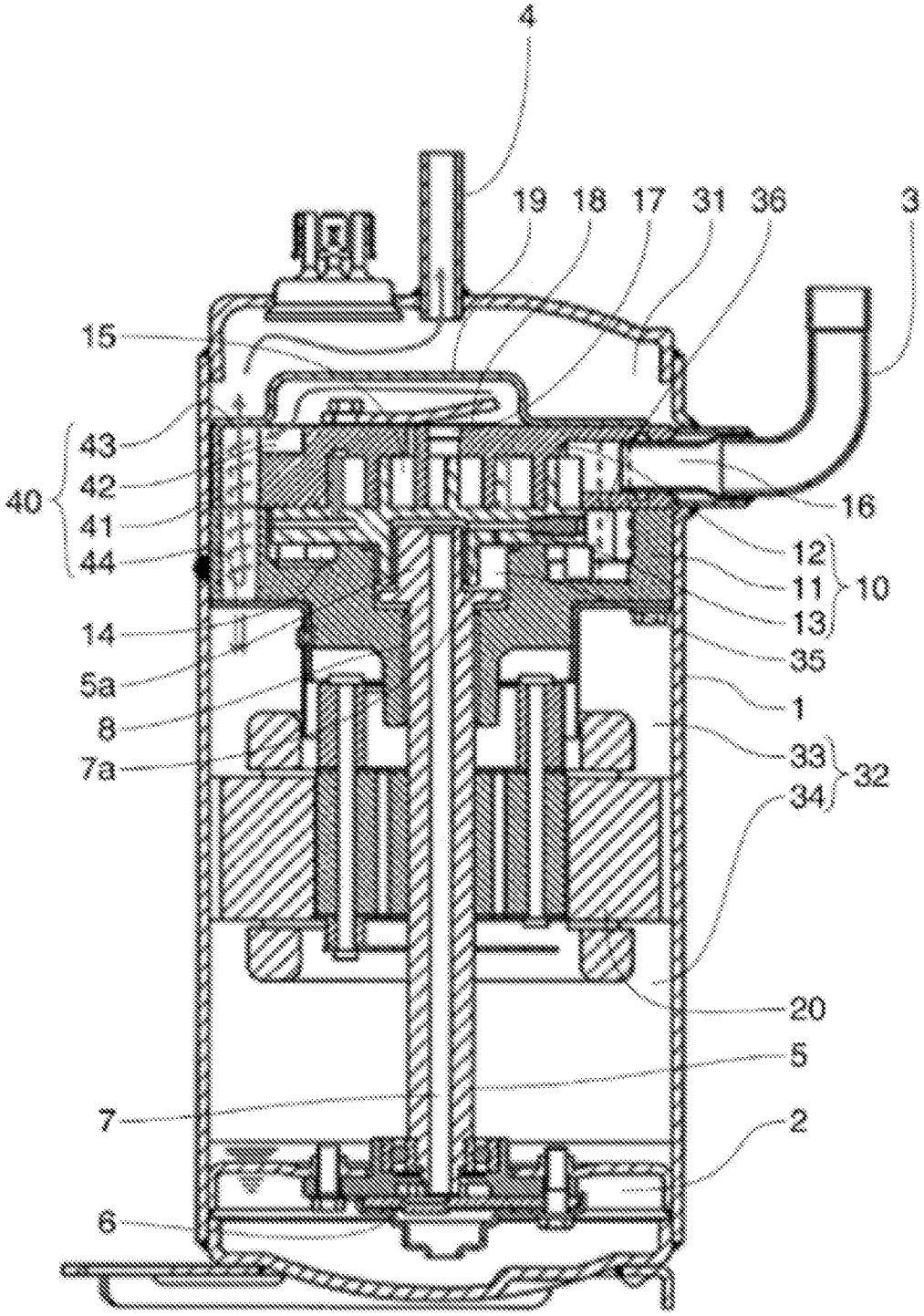
FIG. 1 is a vertical sectional view of a compressor according to a first embodiment of the present invention.

1 container
2 oil reservoir
4 discharge pipe
10 compressing mechanism
11 main bearing member
12 fixed scroll
17 discharge port
19 muffler
20 electric motor
31 container space
32 container space
33 compressing mechanism-side space
34 oil reserving-side space
40 oil separating mechanism
41 cylindrical space
42 inflow portion
43 sending-out port
431 outermost periphery
44 exhaust port
46 cylindrical sending-out pipe
47 cylindrical sending-out pipe
48 refrigerant gas orbiting member

MODE FOR CARRYING OUT THE INVENTION

According to the first aspect, a compressor comprises a container provided therein with a compressing mechanism for compressing refrigerant gas and an electric motor for driving the compressing mechanism, in which an interior of the container is divided by the compressing mechanism into one of container spaces and the other container space, and a discharge pipe for discharging the refrigerant gas to outside of the container from the one container space is provided, and the electric motor is disposed in the other container space, wherein the compressor further comprises an oil separating mechanism which separates oil from the refrigerant gas discharged from the compressing mechanism, the oil separating mechanism includes a cylindrical space in which the refrigerant gas orbits, an inflow portion for flowing the refrigerant gas discharged from the compressing mechanism into the cylindrical space, a sending-out port for sending out, from the cylindrical space to the one container space, the refrigerant gas from which the oil is separated, and an exhaust port for discharging the separated oil and a portion of the refrigerant gas from the cylindrical space, and a center of the sending-out port is deviated in a direction opposite from the inflow portion from a center axis of the cylindrical space.

According to this configuration, most of high temperature and high pressure refrigerant gas which is compressed by the compressing mechanism and sent out from the oil separating mechanism is guided into one of the container spaces and discharged from the discharge pipe. Therefore, since the most of high temperature and high pressure refrigerant gas does not pass through the electric motor, the electric motor is not heated by the refrigerant gas, and efficiency of the electric motor is enhanced.

Further, according to this configuration, most of the high temperature and high pressure refrigerant gas is guided into the one container space, and it is possible to restrain the compressing mechanism which is in contact with the other container space from being heated. Therefore, it is possible to restrain the sucked refrigerant gas from being heated, and high volumetric efficiency in the compression chamber can be obtained.

Further, according to this configuration, oil which is separated by the oil separating mechanism is discharged out together with refrigerant gas from the exhaust port which is disposed opposite to the sending-out port 43*b*. Hence, oil does not build up in the cylindrical space almost at all. Therefore, a case where the separated oil is blown up in the cylindrical space by the orbiting refrigerant gas and is sent out from the sending-out port together to refrigerant gas does not occur, and the oil can be separated stably. Further, since oil does not build up in the cylindrical space, the cylindrical space can be made small.

Further, according to this configuration, the location where a rotation flow rate of the refrigerant gas in the oil separating mechanism is slow and a gas sending-out location are kept away from each other. Hence, it is possible to prevent gas which enters from the inflow portion from which oil is not separated is sent out directly to the sending-out port. Therefore, it is possible to enhance the effect of the oil separating mechanism, and to restrain oil from being discharged into the cycle, and the heat exchanging efficiency of the refrigeration cycle can be enhanced.

According to the second aspect, in the first aspect, the other container space is divided by the electric motor into a compressing mechanism-side space and an oil reserving-side space, the exhaust port is brought into communication with the compressing mechanism-side space, and an oil reservoir is disposed in the oil reserving-side space.

According to this configuration, since the oil reservoir is disposed in the oil reservoir space and oil is not reserved in a space on the side of the compressing mechanism, the container can be made compact.

According to the third aspect, in the first aspect, a muffler which isolates the discharge port of the compressing mechanism from the one container space is disposed, and an interior of the muffler and the cylindrical space are brought into communication with each other through the inflow portion.

According to this configuration, refrigerant gas compressed by the compressing mechanism can reliably be guided to the oil separating mechanism. That is, since all of the refrigerant gas passes through the oil separating mechanism, oil can be separated from the refrigerant gas efficiently.

According to this configuration, most of high temperature refrigerant gas discharged from the discharge port is discharged outside of the container from the discharge pipe without passing through the other container space. Hence, it is possible to restrain the electric motor and the compressing mechanism from being heated.

According to the fourth aspect, in the third aspect, the compressing mechanism includes a fixed scroll, an orbiting scroll disposed such that it is opposed to the fixed scroll, and a main bearing member for supporting a shaft which drives the orbiting scroll, the cylindrical space is formed in each of the fixed scroll and the main bearing member, and the exhaust port is brought into communication with the other container space.

According to this configuration, since the oil separating mechanism is formed in the compressing mechanism, the path through which refrigerant gas flows from the discharge port to the discharge pipe can be made short, and the container can be made compact.

According to this configuration, since oil separated by the oil separating mechanism is discharged into the other container space together with refrigerant gas, oil does not build up in the cylindrical space almost at all.

According to the fifth aspect, in the first aspect, a cross-sectional area A of the sending-out port is set greater than a cross-sectional area B of the exhaust port.

According to this configuration, an amount of refrigerant gas discharged from the exhaust port can be made smaller than that of refrigerant gas sent out from the sending-out port.

According to the sixth aspect, in the fifth aspect, a ratio (A/B) of the cross-sectional area A of the sending-out port and the cross-sectional area B of the exhaust port is 3 or more and 10 or less. According to this configuration, oil can efficiently be separated from refrigerant gas and refrigerant gas discharged from the exhaust port can be suppressed.

According to the seventh aspect, a deviation amount is 5% or more and 30% or less of a diameter of the cylindrical space.

According to this configuration, it is possible to more effectively enhance the effect of the oil separating mechanism.

According to the eighth aspect, an outermost periphery of the sending-out port is located inward of an inner wall of the cylindrical space.

According to this configuration, since a step is formed between the inner wall of the cylindrical space and the sending-out port, it is possible to restrain refrigerant gas orbiting along the inner wall of the cylindrical space from being sent out from the sending-out port before the oil is separated from the refrigerant gas. Therefore, it is possible to further enhance the effect of the oil separating mechanism, and since it is possible to restrain oil from being discharged into the cycle, the heat exchanging efficiency of the refrigeration cycle can be enhanced.

Embodiments of the present invention will be described with reference to the drawings. The invention is not limited to the embodiments.

First Embodiment

FIG. 1 is a vertical sectional view of a compressor according to a first embodiment of the present invention. As shown in FIG. 1, the compressor of the first embodiment includes a container 1 which is provided therein with a compressing mechanism 10 and an electric motor 20. The compressing mechanism 10 compresses refrigerant gas, and the electric motor 20 drives the compressing mechanism 10.

An interior of the container 1 is divided into one of container spaces 31 and the other container space 32 by the compressing mechanism 10. The electric motor 20 is disposed in the other container space 32.

The other container space 32 is divided into a compressing mechanism-side space 33 and an oil reserving-side space 34 by the electric motor 20. An oil reservoir 2 is disposed in the oil reserving-side space 34.

A suction/connection pipe 3 and a discharge pipe 4 are fixed to the container 1 by welding. The suction/connection pipe 3 and the discharge pipe 4 are in communication with outside of the container 1, and are connected to members which configure a refrigeration cycle. The suction/connection pipe 3 introduces refrigerant gas from outside of the container 1, and the discharge pipe 4 discharges refrigerant gas to outside of the container 1 from the one container space 31.

The main bearing member 11 is fixed in the container 1 by welding or shrink fitting, and the main bearing member 11 supports the shaft 5. A fixed scroll 12 is bolted to the main bearing member 11. An orbiting scroll 13 which meshes with the fixed scroll 12 is sandwiched between the main bearing member 11 and the fixed scroll 12. The main bearing member 11, the fixed scroll 12 and the orbiting scroll 13 configure the scroll-type compressing mechanism 10.

A rotation-restraint mechanism 14 such as an Oldham ring is provided between the orbiting scroll 13 and the main bearing member 11. The rotation-restraint mechanism 14 prevents the orbiting scroll 13 from rotating, and guides the orbiting scroll 13 such that it circularly orbits. The orbiting scroll 13 is eccentrically driven by an eccentric shaft 5*a* provided on an upper end of the shaft 5. By this eccentric driving operation, a compression chamber 15 formed between the fixed scroll 12 and the orbiting scroll 13 moves toward a central portion from an outer periphery, reduces its capacity, and compresses.

A suction path 16 is formed between the suction/connection pipe 3 and the compression chamber 15. The suction path 16 is formed in the fixed scroll 12.

A discharge port 17 of the compressing mechanism 10 is formed in a central portion of the fixed scroll 12. The discharge port 17 is provided with a reed valve 18.

A muffler 19 which covers the discharge port 17 and the reed valve 18 is provided on the side of the one container space 31 of the fixed scroll 12. The muffler 19 separates the discharge port 17 away from the one container space 31.

The refrigerant gas is sucked into the compression chamber 15 from the suction/connection pipe 3 through the suction path 16. Refrigerant gas compressed by the compression chamber 15 is discharged into the muffler 19 from the discharge port 17. The reed valve 18 is pushed and opened when the refrigerant gas is discharged from the discharge port 17.

The shaft 5 is provided at its lower end with a pump 6. A suction port of the pump 6 is disposed in the oil reservoir 2 provided in a bottom of the container 1. The pump 6 is driven by the shaft 5. Therefore, the pump 6 can reliably pump up oil in the oil reservoir 2 irrespective of a pressure condition and a driving speed and therefore, lack of oil is not generated around a sliding portion. Oil pumped up by the pump 6 is supplied to the compressing mechanism 10 through an oil supply hole 7 formed in the shaft 5. If foreign substances are removed from oil using an oil filter before or after the oil is pumped up by the pump 6, it is possible to prevent the foreign substances from being mixed into the compressing mechanism 10, and the reliability can further be enhanced.

Pressure of oil guided by the compressing mechanism 10 is substantially the same as discharge pressure of refrigerant gas discharged from the discharge port 17, and the pressure of the oil also becomes a back pressure source for the orbiting scroll 13. According to this configuration, the orbiting scroll 13 is stably operated without separating from the fixed scroll 12 or without partially contacting with the fixed scroll 12. A portion of the oil enters and lubricates a fitting portion between the eccentric shaft 5*a* and the orbiting scroll 13, and a bearing portion 8 between the shaft 5 and the main bearing member 11 to seek for escape by supply pressure or weight of the oil itself and then, the oil drops and returns to the oil reservoir 2.

A path 7*a* is formed in the orbiting scroll 13. One end of the path 7*a* opens at a high pressure region 35, and the other end of the path 7*a* opens at a back pressure chamber 36. The rotation-restraint mechanism 14 is disposed in the back pressure chamber 36.

Therefore, a portion of oil supplied to the high pressure region 35 enters the back pressure chamber 36 through the path 7*a*. The oil which entered the back pressure chamber 36 lubricates a thrust sliding portion and a sliding portion of the rotation-restraint mechanism 14, and gives back pressure to the orbiting scroll 13 in the back pressure chamber 36.

Next, an oil separating mechanism of the compressor according to the first embodiment will be described using FIGS. 1 and 2.

Figure 2:
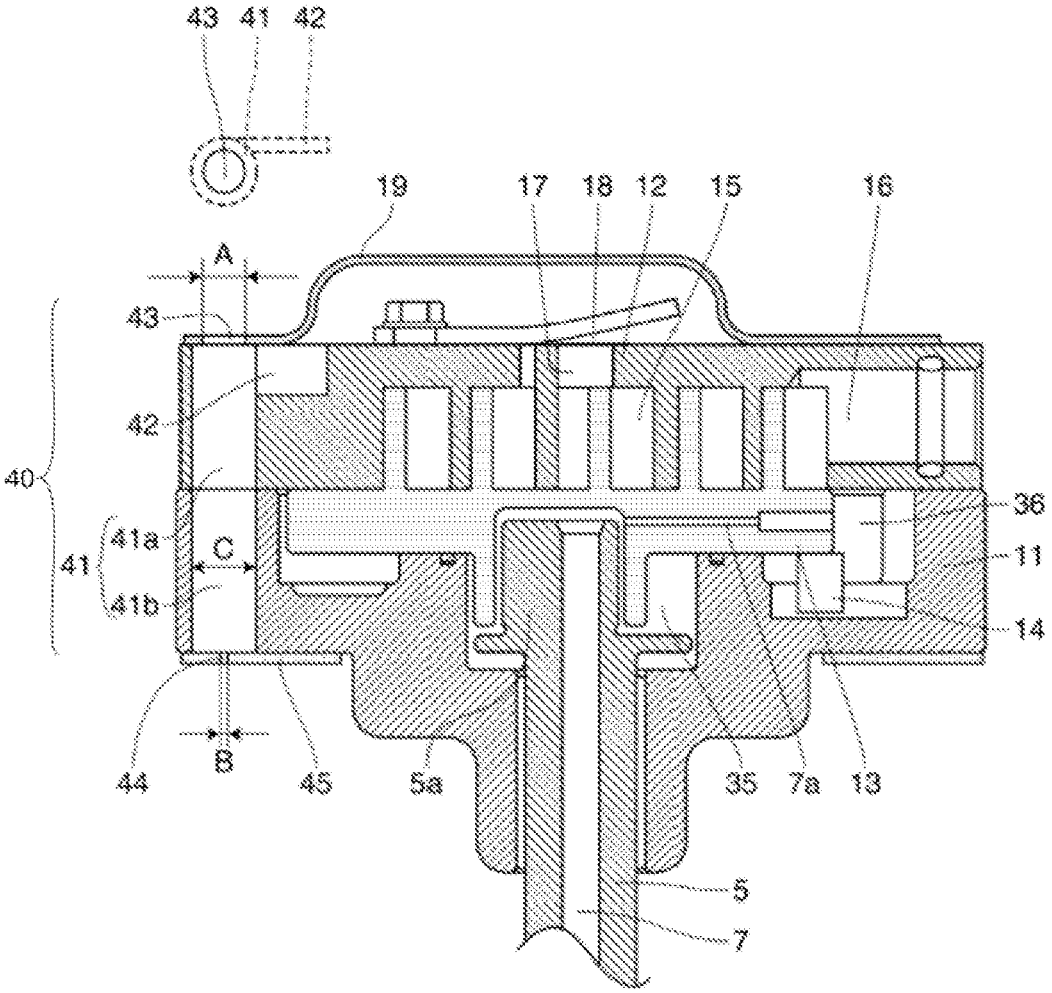
FIG. 2 is an enlarged sectional view of essential portions of the compressing mechanism shown in FIG. 1.

FIG. 2 is an enlarged sectional view of essential portions of the compressing mechanism shown in FIG. 1.

The compressor of the embodiment includes the oil separating mechanism 40 which separates oil from refrigerant gas which is discharged from the compressing mechanism 10.

The oil separating mechanism 40 includes a cylindrical space 41 in which the refrigerant gas orbits, an inflow portion 42 which brings an interior of the muffler 19 and the cylindrical space 41 into communication with each other, a sending-out port 43 which brings the cylindrical space 41 and the one container space 31 into communication with each other, and an exhaust port 44 which brings the cylindrical space 41 and the other container space 32 into communication with each other.

The cylindrical space 41 includes a first cylindrical space 41*a* formed in the fixed scroll 12, and a second cylindrical space 41*b* formed in the main bearing member 11.

The inflow portion 42 is in communication with the first cylindrical space 41*a*, and an opening of the inflow portion 42 is preferably formed in an inner peripheral surface of an upper end of the first cylindrical space 41*a*. The inflow portion 42 makes refrigerant gas which is discharged from the compressing mechanism 10 flow into the cylindrical space 41 from the muffler 19. The inflow portion 42 opens in a tangential direction with respect to the cylindrical space 41.

The sending-out port 43 is formed on the side of an upper end of the cylindrical space 41, and is formed closer to the one container space 31 than at least the inflow portion 42. The sending-out port 43 is preferably formed in an upper end surface of the first cylindrical space 41*a*. The sending-out port 43 sends out, from the cylindrical space 41 to the one container space 31, refrigerant gas from which oil is separated.

The exhaust port 44 is formed on the side of a lower end of the cylindrical space 41, and is formed closer to the other container space 32 than at least the inflow portion 42. The exhaust port 44 is preferably formed in a lower end surface of the second cylindrical space 41*b*. The exhaust port 44 discharges separated oil and a portion of refrigerant gas from the cylindrical space 41 into the compressing mechanism-side space 33.

Here, it is preferable that a cross-sectional area A of an opening of the sending-out port 43 is smaller than a cross-sectional area C of the cylindrical space 41 and is greater than a cross-sectional area B of an opening of the exhaust port 44. If the cross-sectional area A of the opening of the sending-out port 43 is the same as the cross-sectional area C of the cylindrical space 41, an orbiting flow of the refrigerant gas is blown out from the sending-out port 43 without being guided toward the exhaust port 44. If the cross-sectional area B of the opening of the exhaust port 44 is the same as the cross-sectional area C of the cylindrical space 41, the orbiting flow of the refrigerant gas is blown out from the exhaust port 44.

If the cross-sectional area A of the opening of the sending-out port 43 is set greater than the cross-sectional area B of the opening of the exhaust port 44, a path resistance in the sending-out port 43 is reduced. According to this configuration, refrigerant gas easily flows to the sending-out port 43 as compared with the exhaust port 44. As one example, A/B can be set to about 9.

Figure 7:
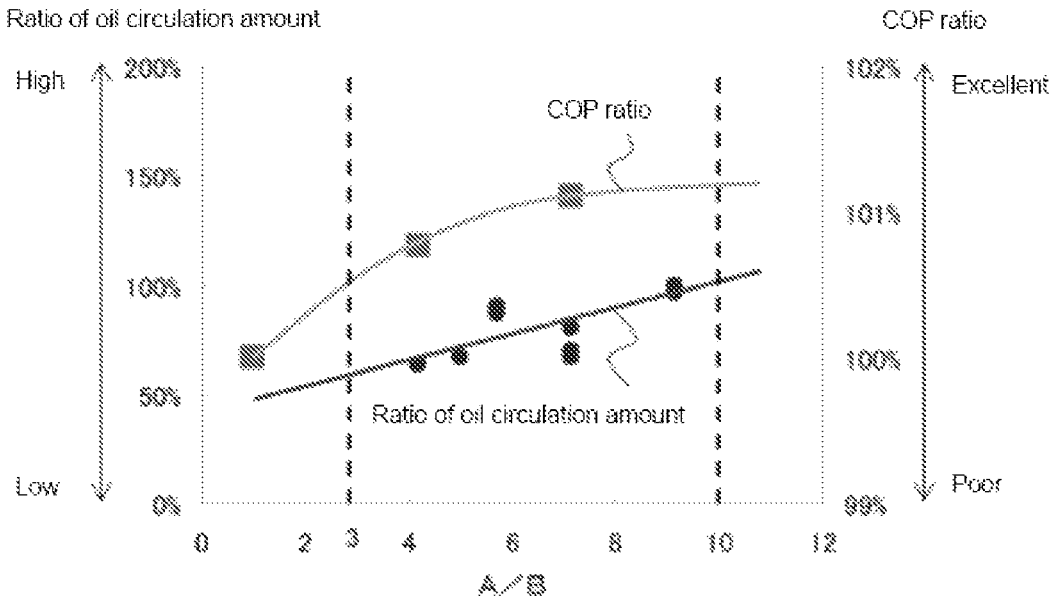
FIG. 7 is a graph showing a relation between an oil-circulation amount ratio and a COP ratio with respect to A/B.

FIG. 7 is a graph showing a relation between an oil-circulation amount ratio and a COP ratio with respect to A/B. From FIG. 7, it can be found that if A/B is reduced (cross-sectional area B of the exhaust port 44 is brought closer to cross-sectional area A of the sending-out port 43), the oil-circulation amount ratio is reduced. This is because that if the amount of refrigerant gas discharged from the exhaust port 44 is increased, the refrigerant gas flows into the space on the side of the electric motor 20, and oil separation caused by collision and contact is facilitated. However, if the refrigerant gas flows into the space close to the electric motor 20, the electric motor 20 is heated by the high temperature refrigerant gas, and efficiency of the electric motor 20 is deteriorated. Further, the refrigerant gas which flowed into the space close to the electric motor 20 passes through the compressing mechanism 10 and is sent into the one container space 31. Therefore, the compressing mechanism 10 is heated, the sucked refrigerant gas is heated, and the volumetric efficiency is deteriorated. As a result, if the A/B becomes excessively small, the COP ratio is reduced and the performance enhancing effect is deteriorated.

From the above-described results, to remarkably exert the performance enhancing effects of both the oil-circulation amount ratio and the COP ratio, it is preferable that the A/B is set to 3 or more and 10 or less.

In this embodiment, a hole is formed in the outer periphery of the fixed scroll 12, thereby forming the first cylindrical space 41*a*, and a hole is formed in the outer periphery of the main bearing member 11, thereby forming the second cylindrical space 41*b*. A groove which opens in the tangential direction is formed in an end surface of the fixed scroll 12 on a side opposite from a lap with respect to the first cylindrical space 41*a*, a portion of the groove on the side of the first cylindrical space 41*a* is covered with the muffler 19, thereby configuring the inflow portion 42. The sending-out port 43 is formed in the muffler 19, and this hole is disposed in the opening of the first cylindrical space 41*a*. A hole formed in the bearing cover 45 configures the exhaust port 44, and this hole is disposed in the opening of the second cylindrical space 41*b*.

An operation of the oil separating mechanism 40 according to the embodiment will be described below.

Refrigerant gas discharged into the muffler 19 is guided to the cylindrical space 41 through the inflow portion 42 formed in the fixed scroll 12. Since the inflow portion 42 opens in the tangential direction with respect to the cylindrical space 41, refrigerant gas which is sent out from the inflow portion 42 flows along an inner wall surface of the cylindrical space 41, and an orbiting flow is generated around the inner peripheral surface of the cylindrical space 41. This orbiting flow becomes a flow moving toward the exhaust port 44.

Oil supplied to the compressing mechanism 10 is included in the refrigerant gas. While the refrigerant gas is orbiting, oil having high specific gravity adheres to an inner wall of the cylindrical space 41 by a centrifugal force, and the oil separates from the refrigerant gas.

The orbiting flow generated around the inner peripheral surface of the cylindrical space 41 turns up at the exhaust port 44, or in the vicinity of the exhaust port 44, and the orbiting flow is changed to an upward-moving stream which passes through the center of the cylindrical space 41.

The refrigerant gas from which oil is separated by the centrifugal force reaches the sending-out port 43 by the upward-moving stream, and is sent out into the one container space 31. The refrigerant gas sent out into the container space 31 is sent to outside of the container 1 from the discharge pipe 4 provided in the one container space 31, and is supplied to the refrigeration cycle.

Oil separated in the cylindrical space 41 is sent out from the exhaust port 44 into the compressing mechanism-side space 33 together with a small amount of refrigerant gas. The oil sent out into the compressing mechanism-side space 33 reaches the oil reservoir 2 through a wall surface of the container 1 or a communication path of the electric motor 20 by a weight of the oil itself.

The refrigerant gas sent into the compressing mechanism-side space 33 passes through a gap of the compressing mechanism 10 and reaches the one container space 31, and is sent to outside of the container 1 from the discharge pipe 4.

According to the oil separating mechanism 40 of the embodiment, the sending-out port 43 is formed closer to the one container space 31 than the inflow portion 42, and the exhaust port 44 is formed closer to the other container space 32 than the inflow portion 42. Hence, the orbiting flow is generated around the inner peripheral surface of the cylindrical space 41 at a location from the inflow portion 42 to the exhaust port 44, and a flow in a direction opposite from the orbiting flow is generated around the center of the cylindrical space 41 at a location from the exhaust port 44 to the sending-out port 43. Therefore, as the exhaust port 44 separates from the inflow portion 42, the orbiting times of the refrigerant gas increase, and the oil separating effect is enhanced. Since the refrigerant gas after the orbiting motion passes through a center of the orbiting flow, it is only necessary that the sending-out port 43 exists further from the discharge port than the inflow portion 42. That is, if a distance between the inflow portion 42 and the exhaust port 44 is increased as mush as possible, the oil orbiting separating effect can be enhanced.

According to the oil separating mechanism 40 of the embodiment, oil is discharged from the exhaust port 44 together with refrigerant gas without building up the separated oil in the container space 32. Therefore, the oil separating mechanism 40 has an effect of guiding the orbiting flow generated around the inner peripheral surface of the cylindrical space 41 in the direction of the exhaust port 44.

If oil is built up in the cylindrical space 41 without forming the exhaust port 44 in the cylindrical space 41, since an outwardly pulling flow from the exhaust port 44 is not generated, the orbiting flow disappears before the orbiting flow reaches the oil surface, or if the orbiting flow reaches the oil surface, the oil is caught up by the orbiting flow. To exert the oil separating function without forming the exhaust port 44 in the cylindrical space 41, it is necessary to form a sufficient space for reserving the oil.

However, if the oil is discharged from the exhaust port 44 together with the refrigerant gas like the oil separating mechanism 40 of the embodiment, it is possible to guide the orbiting flow to the exhaust port 44, and the oil is not caught up.

According to the embodiment, most of high temperature and high pressure refrigerant gas which is compressed by the compressing mechanism 10 and sent out from the oil separating mechanism 40 is guided to the one container space 31 and is discharged from the discharge pipe 4. Therefore, most of the high temperature and high pressure refrigerant gas does not pass through the electric motor 20, the electric motor 20 is not heated by the refrigerant gas, and efficiency of the electric motor 20 is enhanced.

According to the embodiment, most of the high temperature and high pressure refrigerant gas is guided to the one container space 31, and it is possible to restrain the compressing mechanism 10 which is in contact with the other container space 32 from being heated. Hence, it is possible to restrain the sucked refrigerant gas from being heated, and to obtain high volumetric efficiency in the compression chamber.

According to the embodiment, oil separated by the oil separating mechanism 40 is discharged into the other container space 32 together with the refrigerant gas. Hence, oil does not build up in the cylindrical space 41 almost at all. Therefore, the separated oil is not blown up in the cylindrical space 41 by the orbiting refrigerant gas, and the oil is not sent out from the sending-out port 43 together with the refrigerant gas, and oil is stably separated. Further, since oil does not build up in the cylindrical space 41, the cylindrical space 41 can be made compact.

According to the embodiment, the oil reservoir 2 is disposed in the oil reserving-side space 34, and oil is not reserved in the compressing mechanism-side space 33. Hence, the container 1 can be made compact.

According to the embodiment, the muffler 19 which isolates the discharge port 17 of the compressing mechanism 10 from the one container space 31 is disposed, the interior of the muffler 19 and the cylindrical space 41 are brought into communication with each other through the inflow portion 42, and refrigerant gas compressed by the compressing mechanism 10 can reliably be guided to the oil separating mechanism 40. That is, since all of refrigerant gas passes through the oil separating mechanism 40, it is possible to efficiently separate oil from refrigerant gas. Most of high temperature refrigerant gas discharged from the discharge port 17 is discharged to outside of the container 1 from the discharge pipe 4 without passing through the other container space 32. Hence, it is possible to restrain the electric motor 20 and the compressing mechanism 10 from being heated.

According to the embodiment, since the cylindrical space 41 is formed in the fixed scroll 12 and the main bearing member 11, the path through which refrigerant gas flows and which extends from the discharge port 17 to the discharge pipe 4 can be made short, and the container 1 can be made compact.

Second Embodiment

Figure 3:
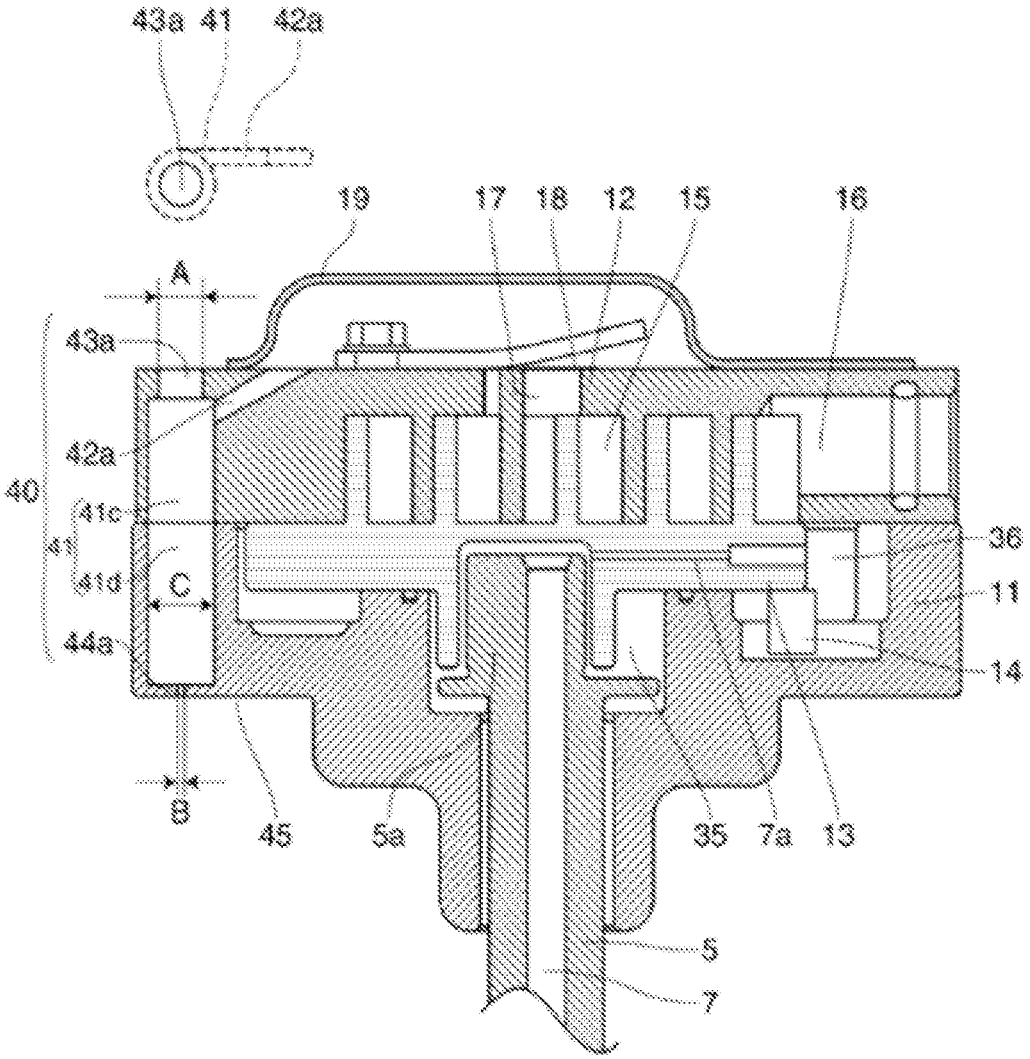
FIG. 3 is an enlarged sectional view of essential portions of a compressing mechanism in a compressor according to a second embodiment of the invention.

FIG. 3 is an enlarged sectional view of essential portions of a compressing mechanism in a compressor according to a second embodiment of the invention.

Since a basic configuration of the embodiment is the same as that shown in FIG. 1, explanation of the same configuration will be omitted. The same constituent members as those described in FIGS. 1 and 2 are designated with the same symbols, and explanation thereof will partially be omitted.

A first cylindrical space 41*c* and a sending-out port 43*a* are formed by forming a stepped-hole in an outer periphery of the fixed scroll 12. The first cylindrical space 41*c* is formed by forming a hole which does not penetrate an end surface (lap-side end surface) of the first cylindrical space 41*c* which is fastened to the main bearing member 11. The sending-out port 43*a* is formed by forming a hole smaller than a cross section of the first cylindrical space 41*c* which penetrates from an end surface (end surface on the side of lap) of the sending-out port 43*a* which is fastened to the main bearing member 11 or from an end surface (end surface opposite from lap) of the sending-out port 43*a* which is not fastened to the main bearing member 11.

A second cylindrical space 41*d* and an exhaust port 44*a* are formed by forming a stepped-hole in an outer periphery of the main bearing member 11. The second cylindrical space 41*d* is formed by forming a hole which does not penetrate from a surface (thrust receiving surface) of the second cylindrical space 41*d* which is fastened to the fixed scroll 12. The exhaust port 44*a* is formed by forming a hole smaller than a cross section of the second cylindrical space 41*d* which penetrates from a surface (thrust surface) of the exhaust port 44*a* which is fastened to the fixed scroll 12, or from a surface (non-thrust surface) of the exhaust port 44*a* which is not fastened to the fixed scroll 12.

The inflow portion 42*a* is formed by forming a through hole which opens in a tangential direction with respect to the first cylindrical space 41*c* from an end surface (end surface opposite from lap) of the fixed scroll 12 which is not fastened to the main bearing member 11.

In this embodiment also, since the operation of the oil separating mechanism 40 is the same as that of the first embodiment and the second embodiment exerts the same operation and effect as those of the first embodiment, explanation thereof will be omitted.

Third Embodiment

Figure 4:
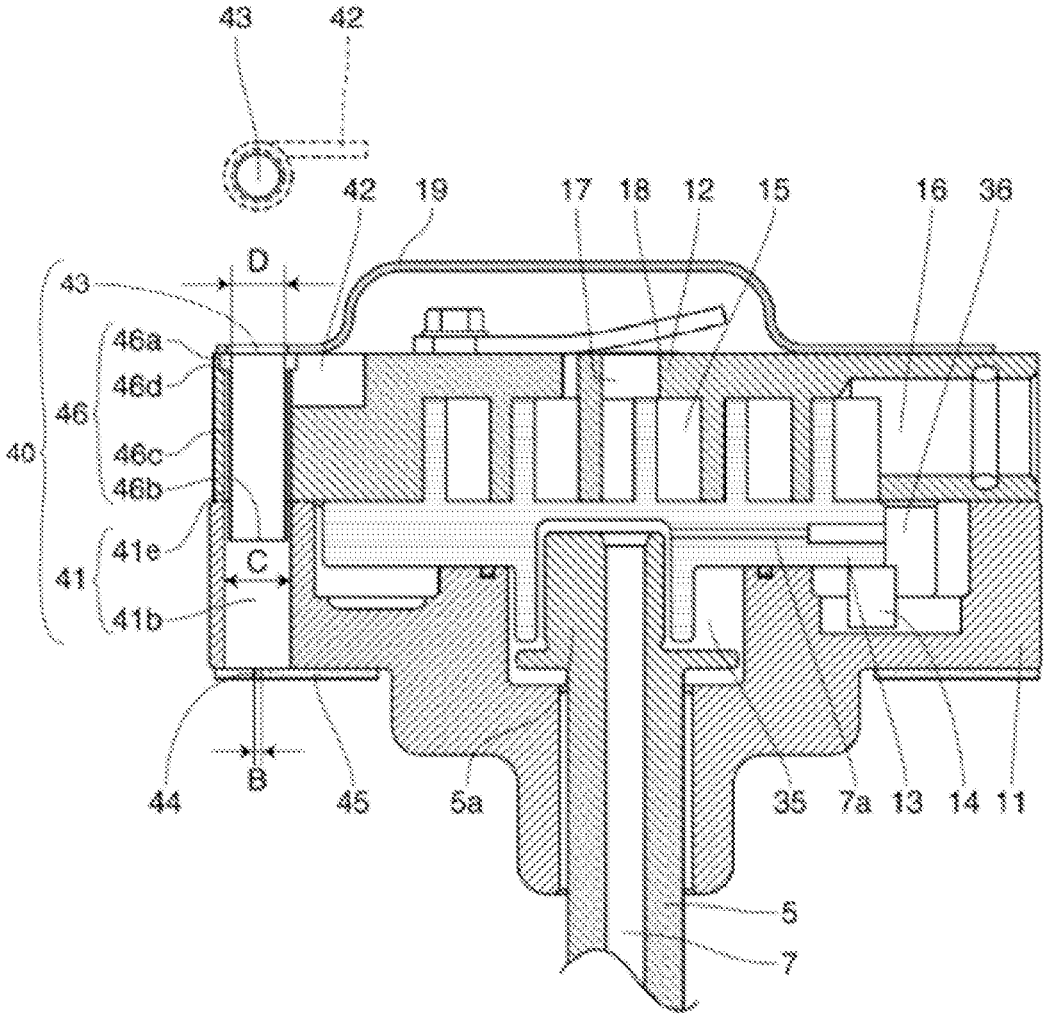
FIG. 4 is an enlarged sectional view of essential portions of a compressing mechanism in a compressor according to a third embodiment of the invention

FIG. 4 is an enlarged sectional view of essential portions of a compressing mechanism in a compressor according to a third embodiment of the invention.

Since a basic configuration of the embodiment is the same as that shown in FIG. 1, explanation of the same configuration will be omitted. The same constituent members as those described in FIGS. 1 and 2 are designated with the same symbols, and explanation thereof will partially be omitted.

In this embodiment, a cylindrical sending-out pipe 46 is provided in the cylindrical space 41.

One end 46*a* of the sending-out pipe 46 forms a sending-out port 43, and the other end 46*b* of the sending-out pipe 46 is disposed in the cylindrical space 41. In this embodiment, the other end 46*b* of the sending-out pipe 46 extends into the second cylindrical space 41*b*.

A ring-shaped space 46*c* is formed in an outer periphery of the sending-out pipe 46, and the inflow portion 42 opens at the ring-shaped space 46*c*. An outwardly extending flange 46*d* is formed on the one end 46*a* of the sending-out pipe 46.

Refrigerant gas which flows from the inflow portion 42 passes through the ring-shaped space 46*c* in a form of an orbiting flow, reaches the exhaust port 44 along the inner peripheral surface of the cylindrical space 41 and then, the refrigerant gas reversely flows through a center of the cylindrical space 41. The refrigerant gas flows into the sending-out pipe 46 from the other end 46*b* of the sending-out pipe 46, and flows out from the one end 46*a* of the sending-out pipe 46.

In this embodiment, a first cylindrical space 41*e* is formed by forming a stepped-hole in an outer periphery of the fixed scroll 12. That is, a hole greater than a cross section of an inner periphery of the first cylindrical space 41*e* is formed in an end surface of the fixed scroll 12 which is not on the side of the lap, and the flange 46*d* of the sending-out pipe 46 is accommodated in this hole. Here, like the first embodiment, the second cylindrical space 41*b* is formed in the main bearing member 11, but the second cylindrical space 41*b* may be formed by forming a stepped-hole in the outer periphery of the main bearing member 11 as in the second embodiment.

As shown in this embodiment, even if frequency is increased and the compressor is operated by providing the sending-out pipe 46 in the cylindrical space 41, the oil separating effect can reliably be obtained.

When the sending-out pipe 46 is provided, it is importance that an axis of the cylindrical space 41 and an axis of the sending-out pipe 46 match with each other.

When the sending-out pipe 46 is provided, it is important that the flange 46*d* is provided on the sending-out pipe 46, the flange 46*d* is disposed in a hole formed in the cylindrical space 41, and the sending-out pipe 46 is fixed to the cylindrical space 41 by the muffler 19.

An inner diameter cross-sectional area D of the sending-out pipe 46 is set greater than a cross-sectional area B of the exhaust port 44. According to this configuration, refrigerant gas easily flows to the sending-out port 43 as compared with the exhaust port 44. As one example, the D/B can be set to about 9.

According to the embodiment, by providing the cylindrical sending-out pipe 46 in the cylindrical space 41, the oil separating effect in the cylindrical space 41 can be enhanced.

Also in this embodiment in which the sending-out pipe 46 is provided, the basic operation of the oil separating mechanism 40 is the same as that of the first embodiment, and the third embodiment exerts the same operation and effect as those of the first embodiment. Therefore, explanation thereof will be omitted.

Fourth Embodiment

Figure 5:
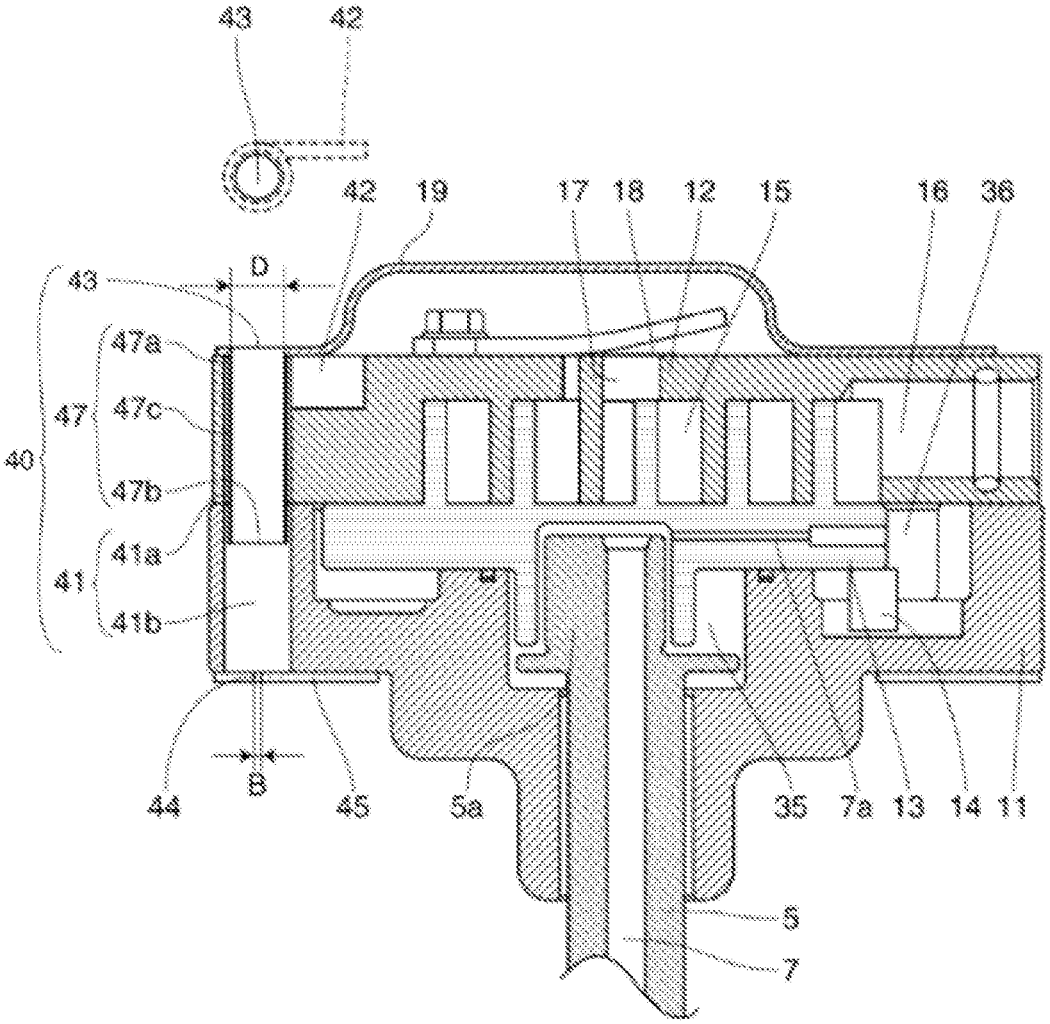
FIG. 5 is an enlarged sectional view of essential portions of a compressing mechanism in a compressor according to a fourth embodiment of the invention.

FIG. 5 is an enlarged sectional view of essential portions of a compressing mechanism in a compressor according to a fourth embodiment of the invention.

Since a basic configuration of the embodiment is the same as that shown in FIG. 1, explanation of the same configuration will be omitted. The same constituent members as those described in FIGS. 1 and 2 are designated with the same symbols, and explanation thereof will partially be omitted.

In this embodiment, a cylindrical sending-out pipe 97 is provided in the cylindrical space 41. The sending-out pipe 97 of the embodiment is integrally formed with the muffler 19.

One end 47*a* of the sending-out pipe 47 forms the sending-out port 43, and the other end 47*b* of the sending-out pipe 47 is disposed in the cylindrical space 41. In this embodiment, the other end 47*b* of the sending-out pipe 47 extends into the second cylindrical space 41*b*.

A ring-shaped space 47*c* is formed in an outer periphery of the sending-out pipe 47, and the inflow portion 42 opens at the ring-shaped space 47*c*. Refrigerant gas which flows from the inflow portion 42 passes through the ring-shaped space 47*c* in a form of an orbiting flow, and reaches the exhaust port 44 along the inner peripheral surface of the cylindrical space 41 and then, reversely flows through a center of the cylindrical space 41. The refrigerant gas flows into the sending-out pipe 47 from the other end 47*b* of the sending-out pipe 47, and flows out from the one end 47*a* of the sending-out pipe 97.

As shown in this embodiment, even if frequency is increased and the compressor is operated by providing the sending-out pipe 47 in the cylindrical space 41, the oil separating effect can reliably be obtained.

When the sending-out pipe 47 is provided, it is importance that an axis of the cylindrical space 41 and an axis of the sending-out pipe 47 match with each other.

When the sending-out pipe 47 is provided, the sending-out pipe 47 can be fixed to the cylindrical space 41 by integrally forming the sending-out pipe 47 with the muffler 19.

An inner diameter cross-sectional area D of the sending-out pipe 47 is set greater than a cross-sectional area B of the exhaust port 44.

According to the embodiment, the oil separating effect in the cylindrical space 41 can be enhanced by providing the cylindrical sending-out pipe 47 in the cylindrical space 41.

Also in this embodiment in which the sending-out pipe 47 is provided, the basic operation of the oil separating mechanism 40 is the same as that of the first embodiment, and the fourth embodiment exerts the same operation and effect as those of the first embodiment. Therefore, explanation thereof will be omitted.

Although the cylindrical space 41 includes the first cylindrical space 41*a* formed in the fixed scroll 12 and the second cylindrical space 41*b* formed in the main bearing member 11 like the first embodiment, the second cylindrical space 41*b* may be formed by forming a stepped-hole in the outer periphery of the main bearing member 11 like the second embodiment.

Fifth Embodiment

Figure 6:
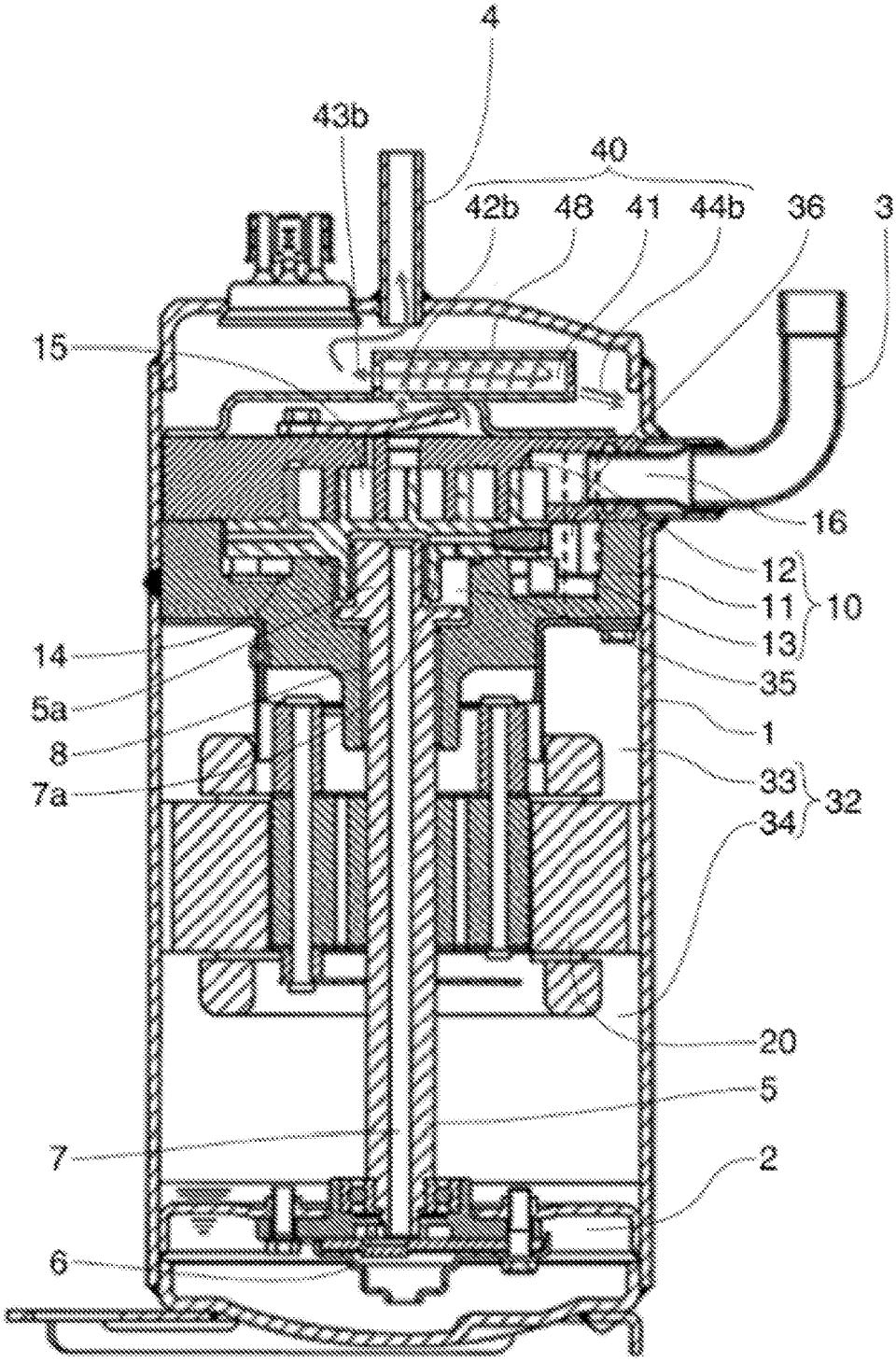
FIG. 6 is a vertical sectional view of a compressor according to a fifth embodiment of the invention.

FIG. 6 is a vertical sectional view of a compressor according to a fifth embodiment of the invention.

Since a basic configuration of this embodiment is the same as that shown in FIG. 1, explanation thereof will be omitted.

In this embodiment, a refrigerant gas orbiting member 48 configuring the cylindrical space 41 is disposed in the one container space 31.

The refrigerant gas orbiting member 48 is disposed on an outer peripheral surface of the muffler 19. The inflow portion 42*b*, a sending-out port 43*b* and an exhaust port 44*b* are formed in the refrigerant gas orbiting member 48.

The inflow portion 42*b* brings an interior of the muffler 19 and the cylindrical space 41 into communication with each other. The sending-out port 43*b* brings the cylindrical space 41 and the one container space 31 into communication with each other. The exhaust port 44*b* brings the cylindrical space 41 and the one container space 31 into communication with each other.

An opening of the inflow portion 42*b* is formed in an inner peripheral surface on the side of one end of the cylindrical space 41. The inflow portion 42*b* makes refrigerant gas discharged from the compressing mechanism 10 flow into the cylindrical space 41 from the muffler 19. The inflow portion 42*b* opens in the tangential direction with respect to the cylindrical space 41.

The sending-out port 43*b* is formed on the side of the one end of the cylindrical space 41, and is formed closer to the one end than at least the inflow portion 42*b*. It is preferable that the sending-out port 43*b* is formed in an end surface on the side of the one end of the cylindrical space 41. The sending-out port 43*b* sends out, from the cylindrical space 41 to the one container space 31, refrigerant gas from which oil is separated.

The exhaust port 44*b* is formed on the side of the other end of the cylindrical space 41, and is formed closer to the other end than at least the inflow portion 42*b*. The exhaust port 44*b* is disposed such that it is opposed to the sending-out port 43*b*. It is preferable that the exhaust port 44*b* is formed in a lower portion of an end surface of the other end of the cylindrical space 41. The exhaust port 44*b* may be formed in a side surface on the side of the other end of the cylindrical space 41. Here, the expression "is opposed to" includes not only a case where the exhaust port 44*b* is provided in a bottom surface of the cylindrical space 41, but also a case where the exhaust port 44*b* is provided in a side surface of the cylindrical space 41.

The exhaust port 44*b* discharges the separated oil and a portion of refrigerant gas from the cylindrical space 41 into the one container space 31. A cross-sectional area A of an opening of the sending-out port 43*b* is smaller than a cross-sectional area C of the cylindrical space 41, and is greater than a cross-sectional area B of an opening of the exhaust port 44*b*.

An operation of the oil separating mechanism 40 of this embodiment will be described below.

Refrigerant gas discharged into the muffler 19 is guided to the cylindrical space 41 through the inflow portion 42*b* formed in an upper surface of the muffler 19. Since the inflow portion 42*b* opens in the tangential direction with respect to the cylindrical space 41, refrigerant gas sent out from the inflow portion 42*b* flows along the inner wall surface of the cylindrical space 41, and an orbiting flow is generated around the inner peripheral surface of the cylindrical space 41. This orbiting flow becomes a flow moving toward the exhaust port 44*b*.

Oil supplied to the compressing mechanism 10 is included in the refrigerant gas, and while the refrigerant gas is orbiting, oil having high specific gravity adheres to an inner wall of the cylindrical space 41 by the centrifugal force, and the oil separates from the refrigerant gas.

The orbiting flow generated around the inner peripheral surface of the cylindrical space 41 turns up at the exhaust port 44*b*, or in the vicinity of the exhaust port 44*b*, the orbiting flow is changed to a reversed flow passing through a center of the cylindrical space 41.

The refrigerant gas from which oil is separated by the centrifugal force reaches the sending-out port 43*b* by the flow passing through the center of the cylindrical space 41, and the refrigerant gas is sent out into the one container space 31. The refrigerant gas sent out into the one container space 31 is sent to outside of the container 1 from the discharge pipe 4 provided in the one container space 31, and is supplied to the refrigeration cycle.

The oil separated in the cylindrical space 41 builds up such that the oil is deviated toward one side by its own weight. Since the exhaust port 44*b* is formed in a lower portion of the end surface on the side of the other end or in a lower portion of the cylindrical space 41, oil can easily be discharged out.

The separated oil is sent out to an upper surface of the muffler 19 from the exhaust port 44*b* together with a small amount of refrigerant gas. The oil sent out to the upper surface of the muffler 19 passes through a gap in the compressing mechanism 10 by its own weight, reaches the compressing mechanism-side space 33 from the one container space 31, and reaches the oil reservoir 2 through a wall surface of the container 1 or a communication path of the electric motor 20.

The refrigerant gas sent out from the exhaust port 44*b* is sent to outside of the container 1 from the discharge pipe 4 provided in the one container space 31, and is supplied to the refrigeration cycle.

In the oil separating mechanism 40 of this embodiment, the sending-out port 43*b* is formed closer to the one end of the cylindrical space 41 than the inflow portion 42*b*, and the exhaust port 44*b* is formed closer to the other end of the cylindrical space 41 than the inflow portion 42*b*. Hence, an orbiting flow is generated around the inner peripheral surface of the cylindrical space 41 at a location from the inflow portion 42*b* to the exhaust port 44*b*, and a flow moving in a direction opposite from the orbiting flow is generated around a center portion of the cylindrical space 41 at a location from the exhaust port 44*b* to the sending-out port 43*b*. Therefore, as the exhaust port 44*b* separates away from the inflow portion 42*b*, the orbiting times of the refrigerant gas increase, and the oil separating effect is enhanced. Since the refrigerant gas after the orbiting motion passes through a center of the orbiting flow, it is only necessary that the sending-out port 43*b* exists further from the exhaust port 44*b* than the inflow portion 42*b*. That is, if a distance between the inflow portion 42*b* and the exhaust port 44*b* is increased as mush as possible, the oil orbiting separating effect can be enhanced.

According to the oil separating mechanism 40 of the embodiment, oil is discharged from the exhaust port 44*b* together with refrigerant gas without building up the separated oil in the cylindrical space 41. Therefore, the oil separating mechanism 40 has an effect of guiding the orbiting flow generated around the inner peripheral surface of the cylindrical space 41 in the direction of the exhaust port 44*b*.

If oil is built up in the cylindrical space 41 without forming the exhaust port 44*b* in the cylindrical space 41, since an outwardly pulling flow from the exhaust port 44*b* is not generated, the oil is caught up by the orbiting flow. To exert the oil separating function without forming the exhaust port 44*b* in the cylindrical space 41, it is necessary to form a sufficient space for reserving the oil.

However, if the oil is discharged from the exhaust port 44*b* together with the refrigerant gas like the oil separating mechanism 40 of the embodiment, it is possible to guide the orbiting flow to the exhaust port 44*b*, and the oil is not caught up.

According to the embodiment, the orbiting and separating motion can be carried out without changing a size of the compressor in its axial direction. Since the orbiting times of refrigerant gas increase, a distance of the cylindrical space 41, more specifically, a distance between the inflow portion 42*b* and the exhaust port 44*b* can be increased. According to this configuration, the oil separating mechanism 40 can be provided in the container 1 while maintaining the size of the compressor itself, and the oil orbiting and separating effect can also be enhanced.

According to the embodiment, the path from the discharge port 17 to the discharge pipe 4 through which refrigerant gas flows can be shortened by disposing the refrigerant gas orbiting member 48 which configures the cylindrical space 41 in the one container space 31, and the container 1 can be made compact.

According to the embodiment, high temperature and high pressure refrigerant gas which is compressed by the compressing mechanism 10 and which is sent out from the oil separating mechanism 40 is guided to the one container space 31, and is discharged from the discharge pipe 4. Therefore, since the high temperature and high pressure refrigerant gas does not pass through the electric motor 20, the electric motor 20 is not heated by the refrigerant gas, and the efficiency of the electric motor 20 is enhanced.

According to the embodiment, by guiding the high temperature and high pressure refrigerant gas to the one container space 31, it is possible to restrain the compressing mechanism 10 which is in contact with the other container space 32 from being heated. Therefore, it is possible to restrain the sucked refrigerant gas from being heated, and to obtain high volumetric efficiency in the compression chamber.

According to the embodiment, oil separated by the oil separating mechanism 40 is discharged into the one container space 31 together with the refrigerant gas. Hence, oil does not build up in the cylindrical space 41 almost at all. Therefore, the separated oil is not blown up in the cylindrical space 41 by the orbiting refrigerant gas, and the oil is not sent out from the sending-out port 43*b* together with the refrigerant gas, and oil is stably separated. Further, since oil does not build up in the cylindrical space 41, the cylindrical space 41 can be made compact.

According to the embodiment, the oil reservoir 2 is disposed in the oil reserving-side space 34, and oil does not build up in the compressing mechanism-side space 33. Hence, the container 1 can be made compact.

According to the embodiment, the muffler 19 which isolates the discharge port 17 of the compressing mechanism 10 from the one container space 31 is disposed, the interior of the muffler 19 and the cylindrical space 41 are brought into communication with each other through the inflow portion 42*b*, and refrigerant gas compressed by the compressing mechanism 10 can reliably be guided to the oil separating mechanism 40. That is, since all of refrigerant gas passes through the oil separating mechanism 40, it is possible to efficiently separate oil from refrigerant gas. The high temperature refrigerant gas discharged from the discharge port 17 is discharged outside of the container 1 from the discharge pipe 4 without passing through the other container space 32. Therefore, it is possible to restrain the electric motor 20 and the compressing mechanism 10 from being heated.

Sixth Embodiment

Figure 8:
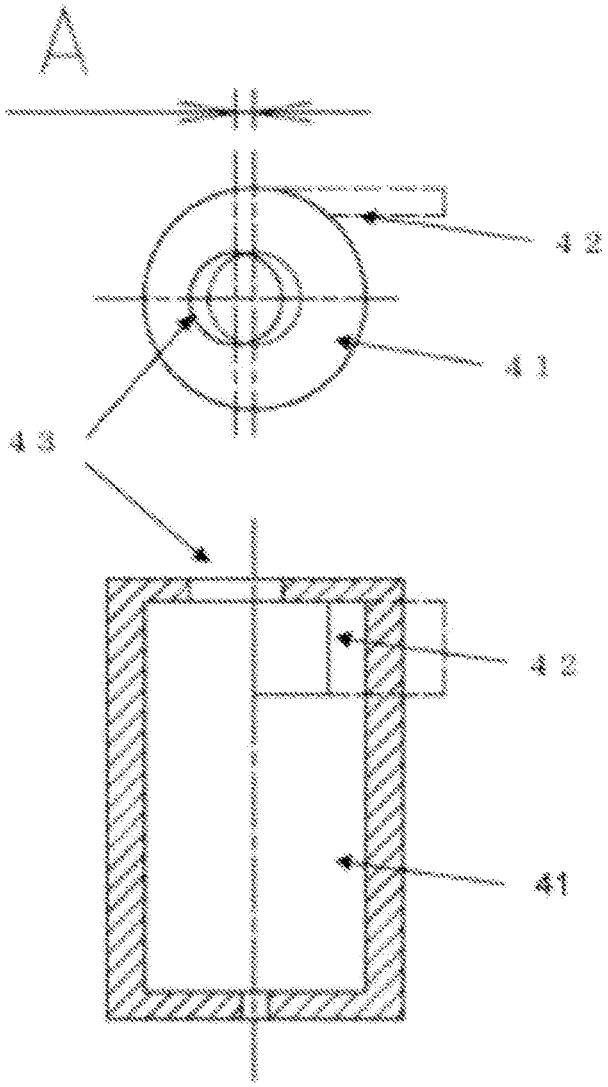
FIG. 8 is a plan view and an enlarged sectional view of essential portions of an oil separating mechanism of a compressor according to a sixth embodiment of the invention.

FIG. 8 is a plan view and an enlarged sectional view of essential portions of an oil separating mechanism of a compressor according to a sixth embodiment of the invention. Since a basic configuration of the embodiment is the same as that shown in FIG. 1, explanation of the same configuration will be omitted. The same constituent members as those described in FIGS. 1 and 2 are designated with the same symbols, and explanation thereof will partially be omitted. This embodiment can be applied to any of the first to fifth embodiments.

In this embodiment, a center of the sending-out port 43 is deviated toward a side substantially opposite from the inflow portion 42 from a center axis of the cylindrical space 41. An eccentric amount shown by a symbol A in FIG. 8 is 5% or more and 30% or less of a diameter of the cylindrical space 41.

By deviating the center of the sending-out port 43 in the direction substantially opposite from the inflow portion 42 from the center axis of the cylindrical space 41, it is possible to prevent a case where refrigerant gas which enters from the inflow portion 42 is sent out from the sending-out port 43 without obtaining the effect of the oil separating mechanism 40. Hence, it is possible to obtain the higher effect of the oil separating mechanism 40. A reason why the refrigerant gas which flows in is sent out directly from the sending-out port 43 is that the refrigerant gas flows toward the sending-out port 43 when the refrigerant gas flows in, or oil separation is completed and the refrigerant gas receives influence of flow of the refrigerant gas which is sent out to the sending-out port 43 and the refrigerant gas is sent out.

In this embodiment, attention is paid to a fact that a flow rate at an inner wall of the cylindrical space 41 which is opposed to the inflow portion 42 is faster than that around the inflow portion 42, and it is found that an influence of refrigerant gas which is sent out is not easily received at a location where the orbiting flow rate is fact.

For example, by deviating the center of the sending-out port 43 from the center axis of the cylindrical space 41 by 10% of a diameter of the cylindrical space 41, it is possible to avoid a case where refrigerant gas which flows in from the inflow portion 42 is sent out from the sending-out port 43 before the effect of the oil separating mechanism is sufficiently obtained, and only refrigerant gas from which oil separates can be sent out. Therefore, it is possible to restrain oil from being discharged to the refrigeration cycle, and to obtain a high heat exchanging rate.

Seventh Embodiment

Figure 9:
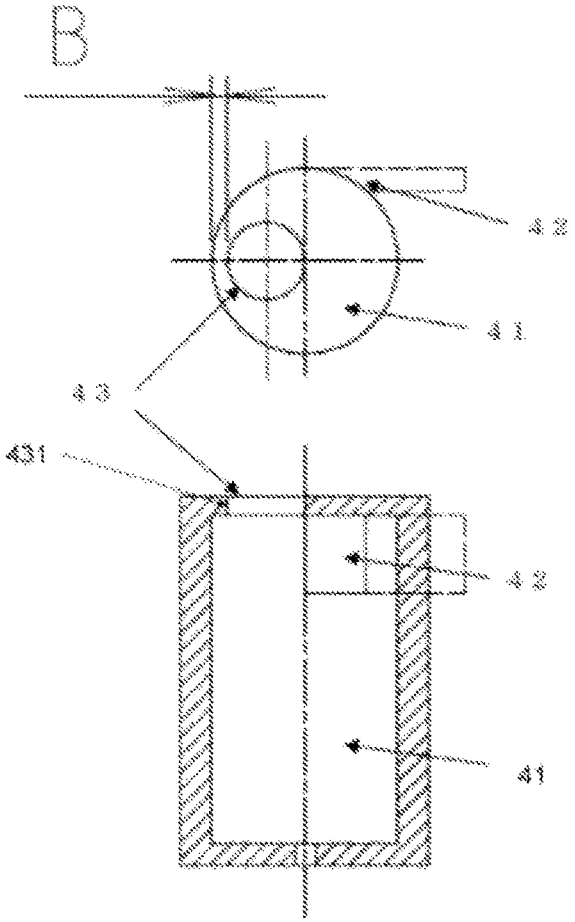
FIG. 9 is a plan view and an enlarged sectional view of essential portions of an oil separating mechanism of a compressor according to a seventh embodiment of the invention.

FIG. 9 is a plan view and an enlarged sectional view of essential portions of an oil separating mechanism of a compressor according to a seventh embodiment of the invention. Since a basic configuration of the embodiment is the same as that shown in FIG. 1, explanation of the same configuration will be omitted. The same constituent members as those described in FIGS. 1 and 2 are designated with the same symbols, and explanation thereof will partially be omitted. This embodiment can be applied to any of the first to sixth embodiments.

This embodiment is characterized in that an outermost periphery 431 of the sending-out port 43 is located inward of an inner wall of the cylindrical space 41.

Since the outermost periphery 431 of the sending-out port 43 is located inward of an inner wall of the cylindrical space 41, a step is formed between the sending-out port 43 and an inner wall of the cylindrical space 41. It is possible to prevent refrigerant gas orbiting along the inner wall of the cylindrical space 41 from which oil is being separated from being sent out along the orbiting flow. Therefore, this configuration of the oil separating mechanism 40 is preferable.

If a distance (shown by B in FIG. 9) of about 10% of a diameter of the cylindrical space 41 is provided between the inner wall of the cylindrical space 41 and the outermost periphery 431 of the sending-out port 43 which is eccentrically provided from the center axis of the cylindrical space 41, the step is formed between the cylindrical space 41 and the sending-out port 43. This step prevents orbiting refrigerant from being sent out along the inner wall of the cylindrical space 41, and only refrigerant gas from which more oil is separated can be sent out and thus, it is possible to restrain oil from being discharged into the refrigeration cycle, and high heat exchanging efficiency can be obtained.

In the compressor of each of the embodiments, two or more cylindrical spaces 41 may be provided.

In the compressor of each of the embodiments, carbon dioxide can be used as refrigerant. Carbon dioxide is high temperature refrigerant, and when such high temperature refrigerant is used, the present invention is further effective.

When carbon dioxide is used as refrigerant, it is preferable to use oil (PAG) including polyalkylene glycol as main ingredient. Here, PAG is insoluble oil, PAG is not dissolved with respect to carbon dioxide refrigerant, and they are mixed in a state where they are separated from each other. Hence, if refrigerant gas and PAG are introduced into the cylindrical space 41, a large centrifugal force is applied to PAG having specific gravity higher than that of the refrigerant gas. As a result, PAG blows off in an outer peripheral direction and PAG adheres to the inner wall of the cylindrical space 41 and therefore, PAG can be separated from the refrigerant gas. That is, if insoluble oil (or immiscible oil) is used, the effect of the invention remarkably appears.

INDUSTRIAL APPLICABILITY

The present invention can be applied to a compressor having a compressing mechanism and an electric motor in a container such as a scroll compressor and a rotary compressor. Especially, the invention is suitable for a compressor using high temperature refrigerant.

The invention claimed is:

1. A compressor comprising a container provided therein with a compressing mechanism for compressing refrigerant gas and an electric motor for driving the compressing mechanism, wherein the compressing mechanism comprises an oil separating mechanism, a fixed scroll, an orbiting scroll disposed so as to oppose the fixed scroll, a main bearing member for supporting a shaft that drives the orbiting scroll, and a discharge port, an interior of the container is divided by the compressing mechanism into a first container space and a second container space, and a discharge pipe for discharging the refrigerant gas to outside of the container from the first container space is provided, and the electric motor is disposed in the second container space, the oil separating mechanism separates oil from the refrigerant gas discharged from the discharge port of the compressing mechanism, and the oil separating mechanism comprises a cylindrical space in which the refrigerant gas flows spirally, the cylindrical space being formed in each of the fixed scroll and the main bearing member, an inflow portion for relaying the refrigerant gas discharged from the compressing mechanism into the cylindrical space before reaching the first container space or the second container space, a sending-out port for sending out the refrigerant gas from which the oil is separated, from the cylindrical space to the first container space, and an exhaust port for discharging the separated oil from the cylindrical space, the exhaust port being brought into communication with the second container space, the sending-out port is formed on a side of an upper end of the cylindrical space, the exhaust port is formed on a side of a lower end of the cylindrical space, and a center of the sending-out port is deviated relative to a center axis of the cylindrical space in a direction opposite to the flow portion.

2. The compressor according to claim 1, wherein the second container space is divided by the electric motor into a compressing mechanism-side space and an oil reserving-side space, the exhaust port is brought into communication with the compressing mechanism-side space, and an oil reservoir is disposed in the oil reserving-side space.

3. The compressor according to claim 1, wherein a muffler which isolates the discharge port of the compressing mechanism from the first container space is present, and an interior of the muffler and the cylindrical space are brought into communication with each other through the inflow portion.

4. The compressor according to claim 1, wherein a deviation ratio of the sending-out port is 5% or more and 30% or less of a diameter of the cylindrical space.

5. The compressor according to claim 1, wherein an outermost periphery of the sending-out port is located inward of an inner wall of the cylindrical space.

6. The compressor according to claim 1, wherein the cylindrical space has a shape of a right circular cylinder.

7. The compressor according to claim 1, wherein the center axis of the cylindrical space is parallel to the shaft through a whole length.

8. The compressor according to claim 1, wherein the sending-out port is located substantially at the same height as the discharge port.

9. The compressor according to claim 1, wherein the sending-out port and the exhaust port are located opposite each other relative to the cylindrical space.

10. The compressor according to claim 1, wherein the refrigerant gas from which the oil is separated flows to the first container space and does not flow to the second container space.

* * * * *